US008610559B2

(12) United States Patent
Cai et al.

(10) Patent No.: US 8,610,559 B2
(45) Date of Patent: Dec. 17, 2013

(54) ENVIRONMENTAL HAZARD WARNING SYSTEM AND METHOD

(75) Inventors: Yi-Wen Cai, New Taipei (TW); Shih-Cheng Wang, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 192 days.

(21) Appl. No.: 13/329,243

(22) Filed: Dec. 17, 2011

(65) Prior Publication Data

US 2013/0154824 A1 Jun. 20, 2013

(51) Int. Cl.
*G08B 1/08* (2006.01)

(52) U.S. Cl.
USPC ..... 340/539.11; 340/586; 340/588

(58) Field of Classification Search
USPC ..... 340/539.11, 573.1, 584, 577, 586, 588, 340/589
See application file for complete search history.

(56) References Cited

U.S. PATENT DOCUMENTS

| | | | | |
|---|---|---|---|---|
| 5,973,602 | A * | 10/1999 | Cole et al. | 340/584 |
| 6,310,552 | B1 * | 10/2001 | Stumberg et al. | 340/573.1 |
| 8,085,144 | B2 * | 12/2011 | Appelt et al. | 340/539.11 |
| 2001/0036832 | A1 | 11/2001 | McKay | |
| 2007/0205903 | A1 * | 9/2007 | diMarzo et al. | 340/573.1 |
| 2009/0174547 | A1 | 7/2009 | Greene et al. | |

* cited by examiner

*Primary Examiner* — Toan N Pham
(74) *Attorney, Agent, or Firm* — Altis Law Group, Inc.

(57) ABSTRACT

An environmental hazard warning system is provided. The environmental hazard warning system includes a data unit, a comparison unit, and an alarm unit. The data unit is capable of storing a plurality protective suit tolerance data. The comparison unit receives a portable sensor parameter signal including a portable sensor parameter from a portable sensor, and compares the portable sensor parameter with the protective suit tolerance data corresponding to the portable sensor parameter. The alarm unit transmits an alarm signal corresponding to the comparison between the portable sensor parameter and the protective suit tolerance data. The disclosure further provides an environmental hazard warning method.

20 Claims, 7 Drawing Sheets

ENVIRONMENTAL HAZARD WARNING SYSTEM AND METHOD

BACKGROUND

1. Technical Field

The present disclosure relates to an environmental hazard warning system and an environmental hazard warning method, and particularly to an environmental hazard warning system and an environmental hazard warning method for an emergency personnel under the protection of a protective suit.

2. Description of Related Art

In the scene of a fire, in addition to flames and smoke, there could have invisible threats such as high temperature, toxic gas, hazardous acid and base, exposed electrical wiring, or radioactive materials, for example. Even though under the protection of protective suits, the safety of emergency personnel cannot be ensured under extreme environmental conditions since the effect of protection is restricted by physical limitations of the protective suits.

What is needed, therefore, is an environmental hazard warning system capable of overcoming the limitation described.

BRIEF DESCRIPTION OF THE DRAWINGS

Many aspects of the present disclosure can be better understood with reference to the following drawing(s). The components in the drawing(s) are not necessarily drawn to scale, the emphasis instead being placed upon clearly illustrating the principles of the present disclosure. Moreover, in the drawing(s), like reference numerals designate corresponding parts throughout the several views.

DETAILED DESCRIPTION

Figure 1:
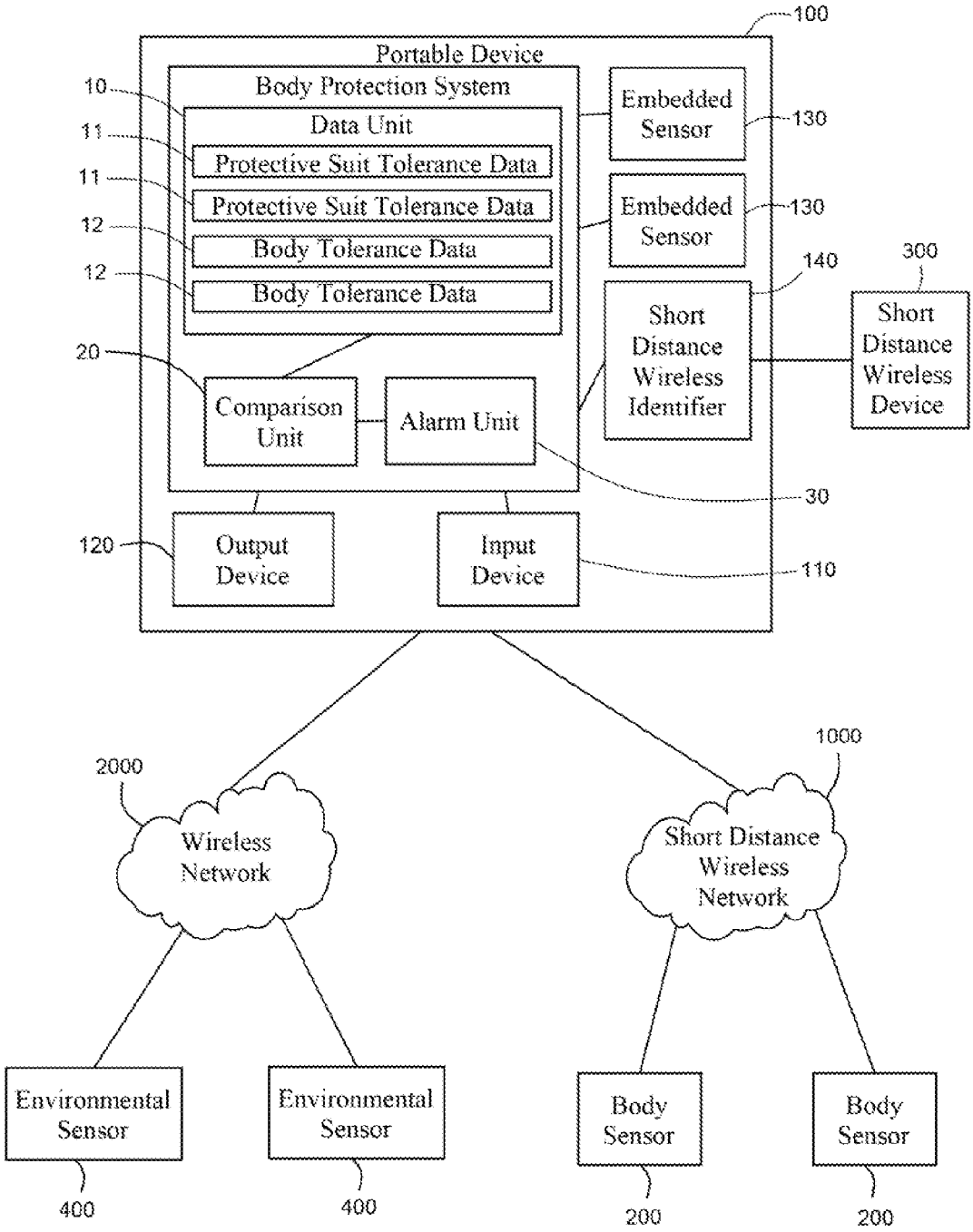
FIG. 1 is a block diagram of an embodiment of an environmental hazard warning system of the present disclosure.

FIG. 1 is a block diagram of an embodiment of an environmental hazard warning system of the present disclosure. In the illustrated embodiment, the environmental hazard warning system is applied to a firefighter under the protection of a fire proximity suit. In other embodiments, the environmental hazard warning system can be applied to other types of emergency personnel under the protection of other types of protective suits, for example, riot control officers under the protection of protective equipment. As shown in FIG. 1, an environmental hazard warning system includes a data unit 10, a comparison unit 20, and an alarm unit 30. The environmental hazard warning system is installed in a portable device 100 including an input device 110, an output device 120, embedded sensors 130, and a short distance wireless identifier 140. The portable device 100 can be a public safety radio, a smart phone, a tablet computer, a notebook computer, or other types of portable electronic devices.

The data unit 10 is capable of storing a plurality of protective suit tolerance data 11. The protective suit tolerance data 11 can be, for example, a safe limit for temperature, humidity, acidic materials, base materials, electrical voltages and/or current, hazardous radioactive materials, or other values of the environmental parameters of an emergency scene. The value the protective suit tolerance data 11 can be defined according to the parameter of a protective suit such as a fire proximity suit. For instance, if the protective suit can be normally used in temperatures between 0 degree centigrade and 50 degrees centigrade according to the thermal tolerance of the protective suit, the range of the protective suit tolerance data 11 can be accordingly defined between 0 degree centigrade and 50 degrees centigrade.

The comparison unit 20 receives a portable sensor parameter signal Sp including a portable sensor parameter Pp from a portable sensor, that is, one of embedded sensors 130 and body sensors 200. The portable sensor parameter Pp can be, for example, temperature, humidity, acidic materials, base materials, electrical voltages and/or current, hazardous radioactive materials, or other environmental parameters of the emergency scene. Correspondingly, each of the embedded sensors 130 and the body sensors 200 can be a type of sensor, which is capable of detecting one of the different portable sensor parameters Pp. In response to receiving the portable sensor parameter signal Sp, the comparison unit 20 compares the portable sensor parameter Pp in the portable sensor parameter signal Sp, with the protective suit tolerance data 11 corresponding to the portable sensor parameter Pp. For example, if the portable sensor parameter Pp is a temperature, the comparison unit 20 compares the temperature with the protective suit tolerance data 11 including a range of temperature.

Embedded sensors 110 are embedded in the portable device 100. The body sensors 200 can be carried on the protective suit or attached to the body of the user of the portable device 100 while the location of the body sensors 200 can be arranged according to actual demands such as the type of the body sensors 200. The body sensors 200 communicate with the portable device 100 through a short distance wireless network 1000. In the illustrated embodiment, the short distance wireless network 1000 is implemented according to BLUETOOTH telecommunication standard. In other embodiments, the short distance wireless network 1000 can be implemented according to other telecommunication standards such as near field communication (NFC).

The alarm unit 30 transmits an alarm signal Sa to the output device 120 corresponding to the comparison between the portable sensor parameter Pp and the protective suit tolerance data 11. In the illustrated embodiment, when the portable sensor parameter Pp is not within the protective suit tolerance data 11, the alarm unit 30 transmits the alarm signal Sa to the output device 120 to enable the output device 120 to provide a warning message M (not shown). For instance, when the portable sensor parameter Pp is a temperature of 60 degrees centigrade while the protective suit tolerance data 11 is a range of temperature between 0 degrees centigrade and 50 degrees centigrade, the alarm unit 30 transmits the alarm signal Sa to the output device 120 since the temperature exceeds the range of temperature. In the illustrated embodiment, the output device 120 is a speaker, which provides the warning message M, which is audio. In other embodiments, the output device 120 can be other types of electronic devices, which are capable of providing the warning message M visually which can attract the attention of the user of the portable device 100. For example, the output device 120 can be augmented reality glasses, which display an augmented reality image including the warning message M according to the alarm signal Sa, wherein the portable device 100 can be a helmet while the output device 120 is a face mask of the helmet.

In the illustrated embodiment, the protective suit tolerance data 11 is inputted through the short distance wireless identifier 140. When the short distance wireless identifier 140 receives a protective suit parameter signal Ss, including a protective suit parameter Ps, of the protective suit from a short distance wireless device 300, which is installed on the protective suit, the data unit 10 transforms the protective suit parameter Ps in the protective suit parameter signal Ss to the protective suit tolerance data 11. For instance, when the protective suit parameter Ps is an identifier of the protective suit, the data unit 10 selects pre-inputted protective suit tolerance data of the protective suit as the protective suit tolerance data 11. In addition, when the protective suit parameter Ps is the parameter of the protective suit such as thermal tolerance, the data unit 10 stores the parameter as the protective suit tolerance data 11. In the illustrated embodiment, the short distance wireless identifier 140 is a RFID (radio-frequency identification) reader, and the short distance wireless device 300 is a RFID tag. In addition, the protective suit tolerance data 11 can also be input through the input device 110. The input device 110 can be a keyboard, a touch panel, a microphone, or other types of human-machine interface (HMI).

In the embodiment, the data unit 10 can be further capable of storing a plurality of body tolerance data 12. The body tolerance data 12 is input through the input device 110. The body tolerance data 12 can be, for example, a safe limit for temperature, humidity, oxygen, toxic gas, blood pressure, pulse rate, or other values of biometric parameters, and the portable sensor parameter Pp can further be, for example, temperature, humidity, oxygen thickness, toxic gas thickness, blood pressure, pulse rate, or other biometric parameters. The value of each of the body tolerance data 12 can be defined according to the endurance of a body. For instance, if the user of the portable device 100 can endure temperatures between 0 degree centigrade and 35 degrees centigrade, the range of the body tolerance data 12 can be accordingly defined between 0 degree centigrade and 35 degrees centigrade. Correspondingly, the comparison unit 20 further compares the portable sensor parameter Pp in the portable sensor parameter signal Sp with the body tolerance data 12 corresponding to the portable sensor parameter Pp, and then the alarm unit 30 transmits the alarm signal Sa to the output device 120 when the portable sensor parameter is not within the body tolerance data 12, thereby enabling the output device 120 to provide the warning message M.

In the illustrated embodiment, the comparison unit 20 further receives a stationary sensor parameter signal Sf including a stationary sensor parameter Pf from a stationary sensor disposed in the emergency scene, that is, one of the environmental sensors 400. Each of the environmental sensors 400 can be a type of sensor, which is capable of detecting one of the different portable sensor parameters Pp. In response to receiving the stationary sensor parameter signal Sf, the comparison unit 20 compares the portable sensor parameter Pp in the portable sensor parameter signal Sp with the protective suit tolerance data 11 corresponding to the portable sensor parameter Pp as well as the stationary sensor parameter Pf in the stationary sensor parameter signal Sf with the protective suit tolerance data 11 corresponding to the stationary sensor parameter Pf. The alarm unit 30 transmits the alarm signal Sa according to the comparison between the portable sensor parameter Pp and the protective suit tolerance data 11 corresponding to the portable sensor parameter Pp as well as the comparison between the stationary sensor parameter Pf and the protective suit tolerance data 11 corresponding to the stationary sensor parameter Pf. In the illustrated embodiment, if the portable sensor parameter Pp and the stationary sensor parameter Pf belong to a same type of parameter such as temperature, the portable sensor parameter Pp and the stationary sensor parameter Pf correspond to the same protective suit tolerance data 11, and the alarm unit 30 transmits the alarm signal Sa to the output device 120 when any of the portable sensor parameter Pp and the stationary sensor parameter Pf is not within the protective suit tolerance data 11.

Figure 2A:
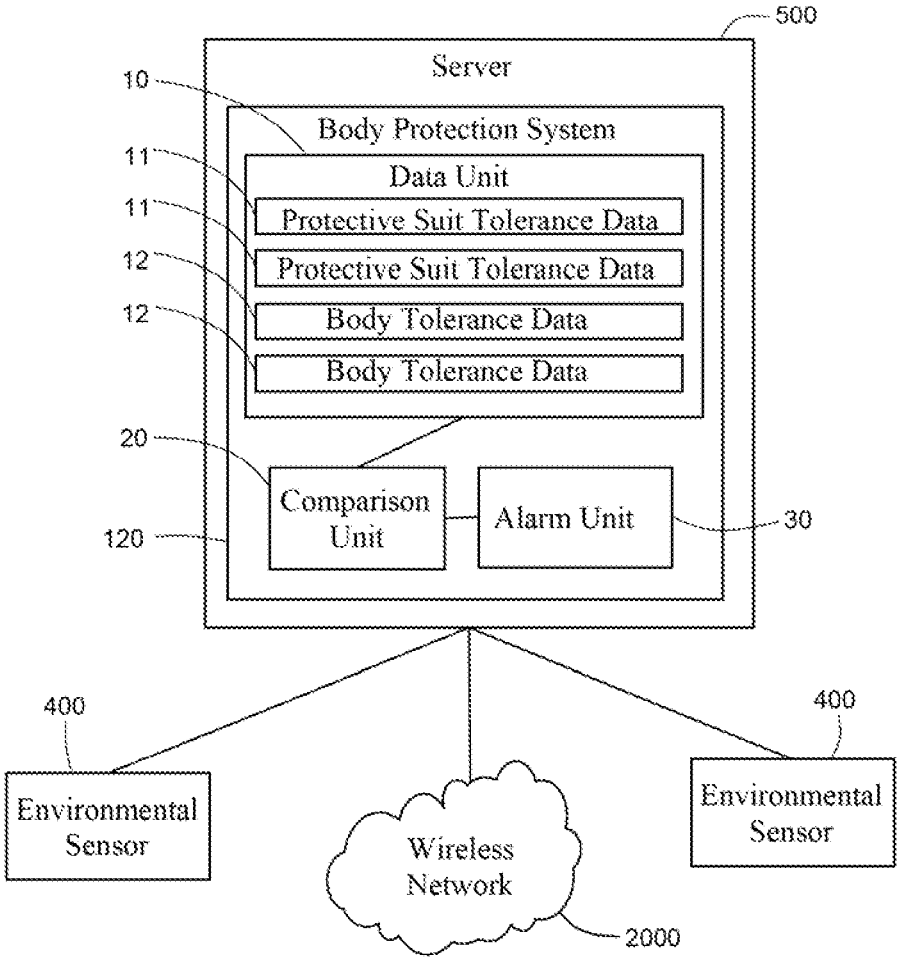
FIG. 2A/2B is a block diagram of another embodiment of an environmental hazard warning system of the present disclosure.
Figure 2B:
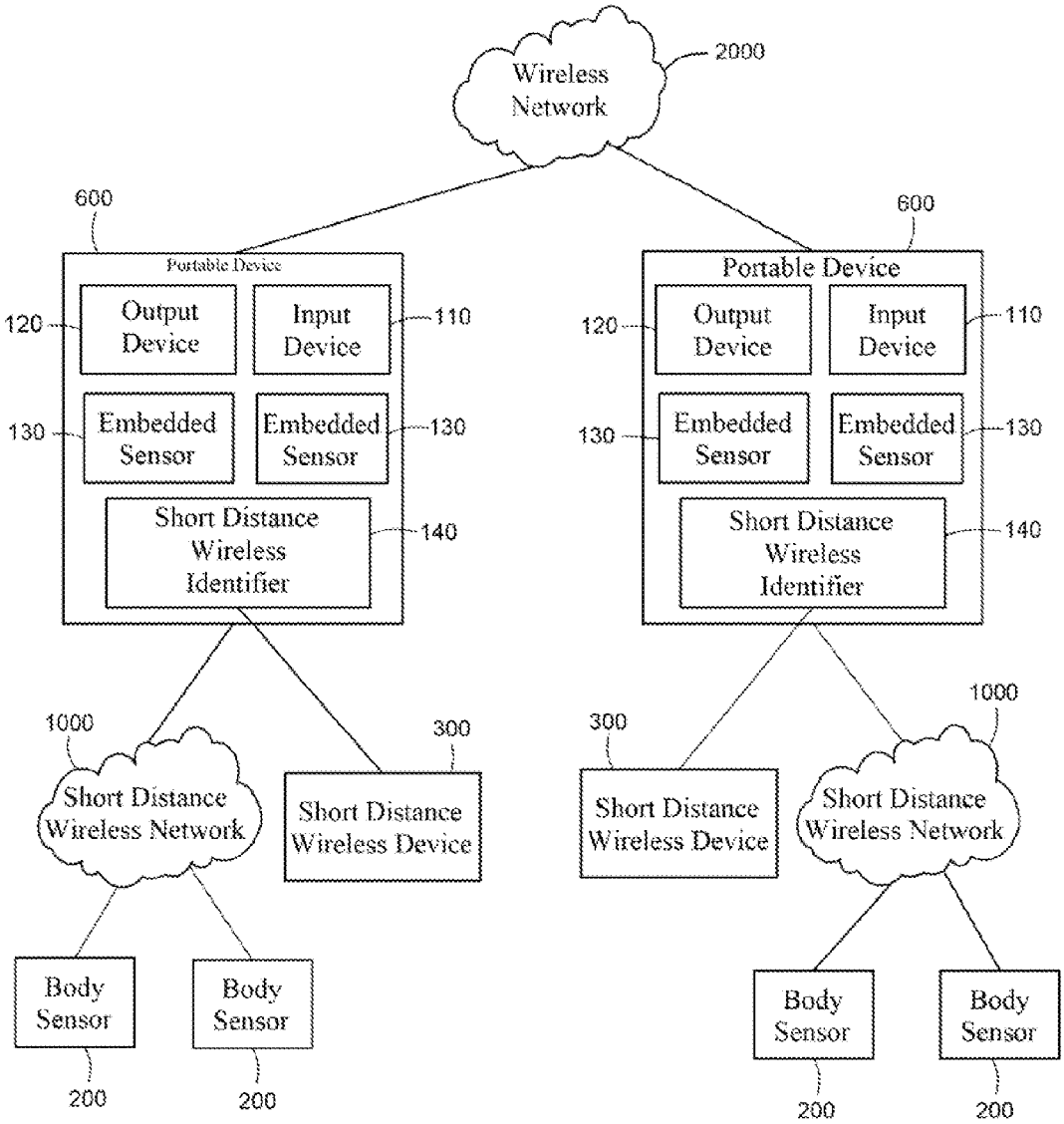

FIG. 2A/2B is a block diagram of another embodiment of an environmental hazard warning system of the present disclosure. As shown in FIG. 2A/2B, the environmental hazard warning system is installed in a server 500, which communicates with a portable device 600 through a wireless network 2000. The portable device 600 includes the input device 110, the output device 120, the embedded sensors 130, and the short distance wireless identifier 140 as described above. The comparison unit 20 receives the portable sensor parameter signal Sp and the protective suit parameter signal Ss through the portable device 600, while the portable device 600 receives the stationary sensor parameter signal Sf from the environmental sensors 400 through the server 500.

Figure 3:
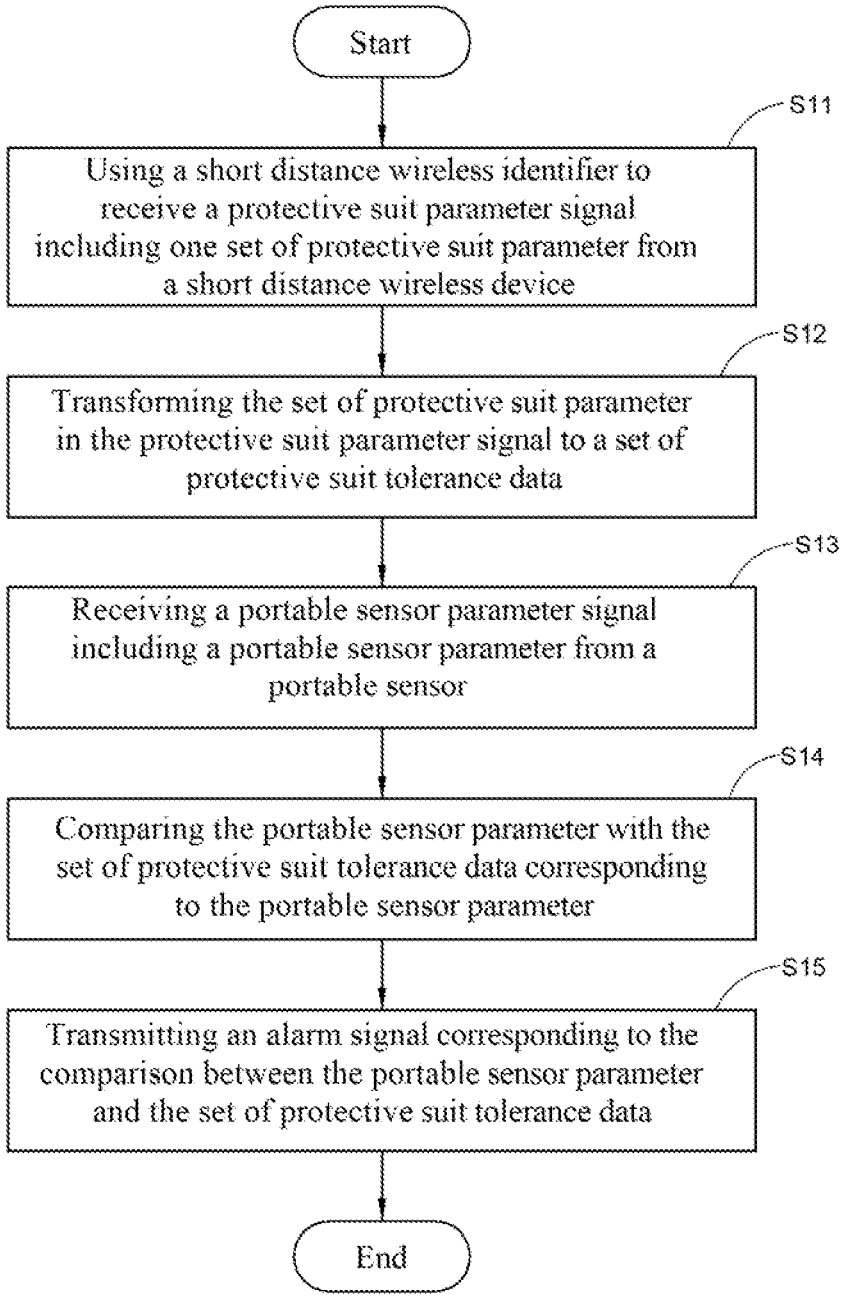
FIG. 3 is a flowchart of a first embodiment of an environmental hazard warning method of the present disclosure.

FIG. 3 is a flowchart of a first embodiment of an environmental hazard warning method of the present disclosure. In the illustrated embodiment, the environmental hazard warning method is applied to a firefighter under the protection of a fire proximity suit. As shown in FIG. 3, the environmental hazard warning method of the present disclosure is as follows. Depending on the embodiment, additional steps may be added, others removed, and the ordering of the steps may be changed.

In step S11, a short distance wireless identifier is used to receive a protective suit parameter signal including the protective suit parameter from a short distance wireless device. In the illustrated embodiment, the short distance wireless identifier is a RFID reader, and the short distance wireless device is a RFID tag.

In step S12, the protective suit parameter in the protective suit parameter signal is transformed to protective suit tolerance data. The protective suit tolerance data can be, for example, a safe limit for temperature, humidity, acidic materials, base materials, electrical voltages and/or current, hazardous radioactive materials, or other values of the environmental parameters of an emergency scene. The protective suit parameter can be transformed to the protective suit tolerance data by, for instance, deriving the higher limits and/or the lower limits from the protective suit parameters defined as ranges.

In step S13, a portable sensor parameter signal including a portable sensor parameter is received from a portable sensor. The portable sensor parameter can be, for example, temperature, humidity, oxygen thickness, toxic gas thickness, strong acid strength, strong base strength, electricity leakage amount, radioactive ray strength, or other environmental parameters of the emergency scene.

In step S14, the portable sensor parameter is compared with the protective suit tolerance data corresponding to the portable sensor parameter.

In step S15, an alarm signal is transmitted corresponding to the comparison between the portable sensor parameter and the protective suit tolerance data. In the illustrated embodiment, when the portable sensor parameter is not within the protective suit tolerance data, the alarm signal is transmitted to an output device to enable the output device to provide a warning message.

In the illustrated embodiment, the steps of the environmental hazard warning method are implemented through a portable device, while the portable sensor communicates with the portable device through a short distance wireless network. The warning message is provided via audio or visual means which can attract the attention of the user of the portable device. For instance, the portable device can display an augmented reality image through augmented reality glasses according to the alarm signal. In other embodiments, the environmental hazard warning system can be implemented through a server, which communicates with a portable device through a wireless network.

Figure 4:
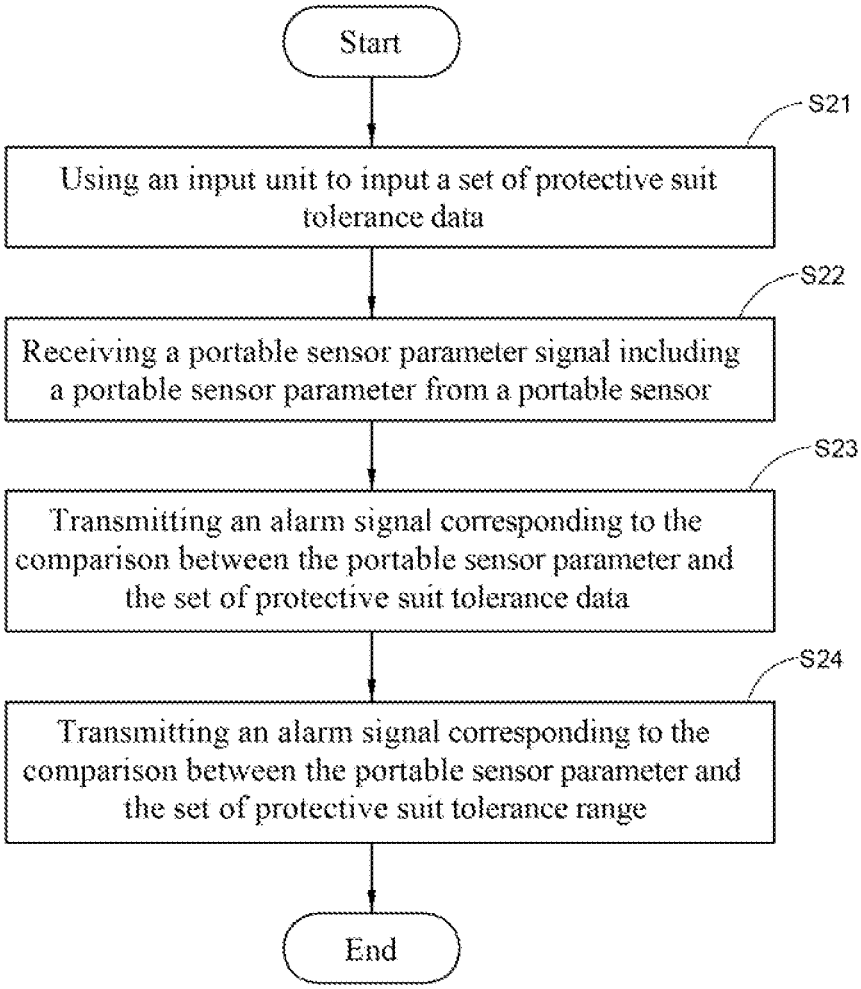
FIG. 4 is a flowchart of a second embodiment of an environmental hazard warning method of the present disclosure.

FIG. 4 is a flowchart of a second embodiment of an environmental hazard warning method of the present disclosure. As shown in FIG. 4, the environmental hazard warning method of the present disclosure is as follows. Depending on the embodiment, additional steps may be added, others removed, and the ordering of the steps may be changed.

In step S21, an input device is used to input a protective suit tolerance data.

In step S22, a portable sensor parameter signal including a portable sensor parameter is received from a portable sensor.

In step S23, the portable sensor parameter is compared with the protective suit tolerance data corresponding to the portable sensor parameter.

In step S24, an alarm signal is transmitted corresponding to the comparison between the portable sensor parameter and the protective suit tolerance data.

Figure 5:
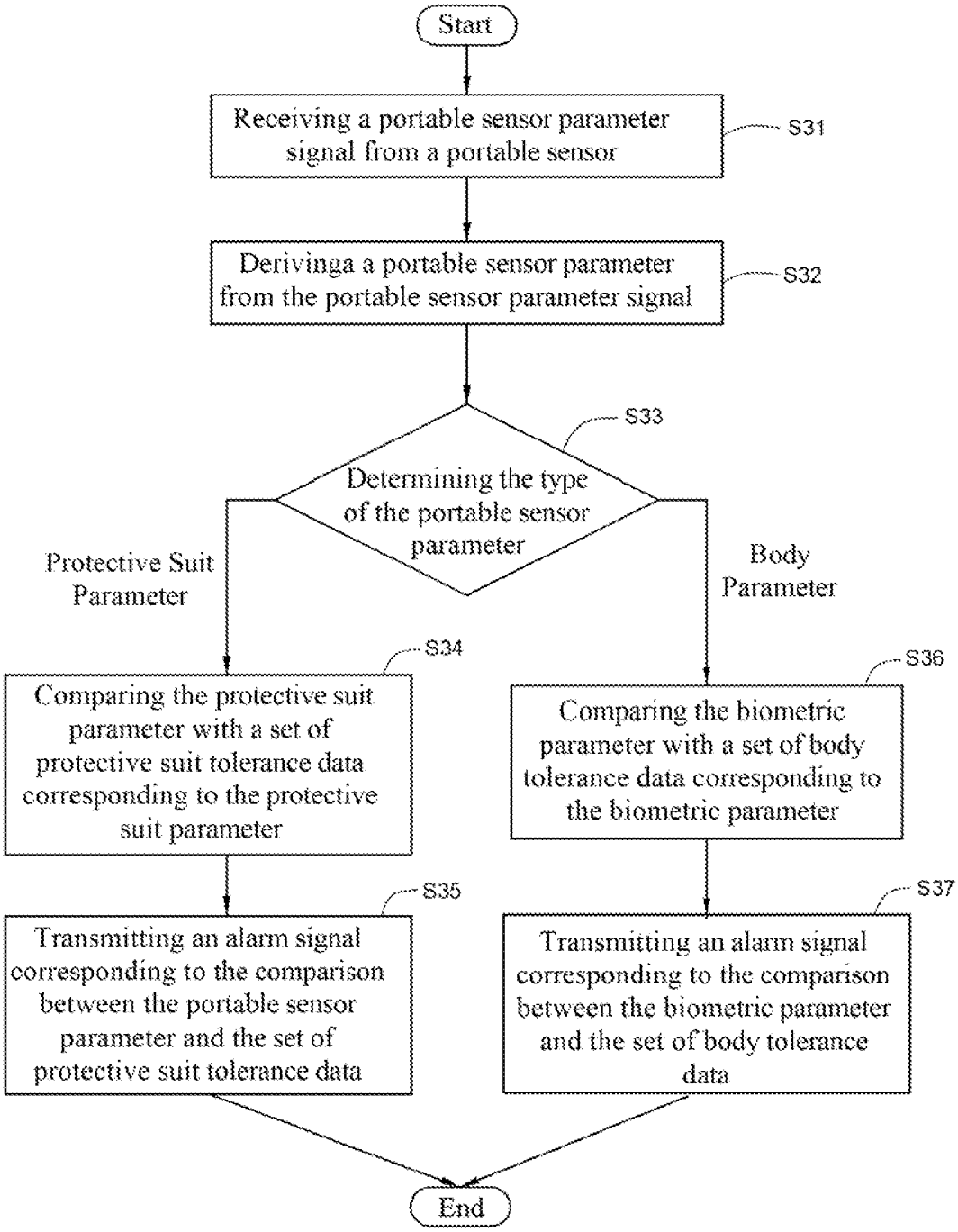
FIG. 5 is a flowchart of a third embodiment of an environmental hazard warning method of the present disclosure.

FIG. 5 is a flowchart of a third embodiment of an environmental hazard warning method of the present disclosure. As shown in FIG. 5, the environmental hazard warning method of the present disclosure is as follows. Depending on the embodiment, additional steps may be added, others removed, and the ordering of the steps may be changed.

In step S31, a portable sensor parameter signal is received from a portable sensor In step S32, a portable sensor parameter is derived from the portable sensor parameter signal.

In step S33, the type of the portable sensor parameter is determined. If the portable sensor parameter is an environmental parameter, step S34 is implemented; if the portable sensor parameter is a biometric parameter, step S36 is implemented.

In step S34, the environmental parameter is compared with protective suit tolerance data corresponding to the environmental parameter.

In step S35, an alarm signal is transmitted corresponding to the comparison between the environmental parameter and the protective suit tolerance data.

In step S36, the biometric parameter is compared with body tolerance data corresponding to the biometric parameter. The body tolerance data is input through an input device. The body tolerance data can be, for example, a safe limit for temperature, humidity, oxygen, toxic gas, blood pressure, pulse rate, or other values of biometric parameters, and the biometric parameter can be, for example, temperature, humidity, oxygen thickness, toxic gas thickness, blood pressure, or pulse rate. The value of the body tolerance data can be defined according to the endurance of a body In step S37, an alarm signal is transmitted corresponding to the comparison between the biometric parameter and the body tolerance data.

Figure 6:
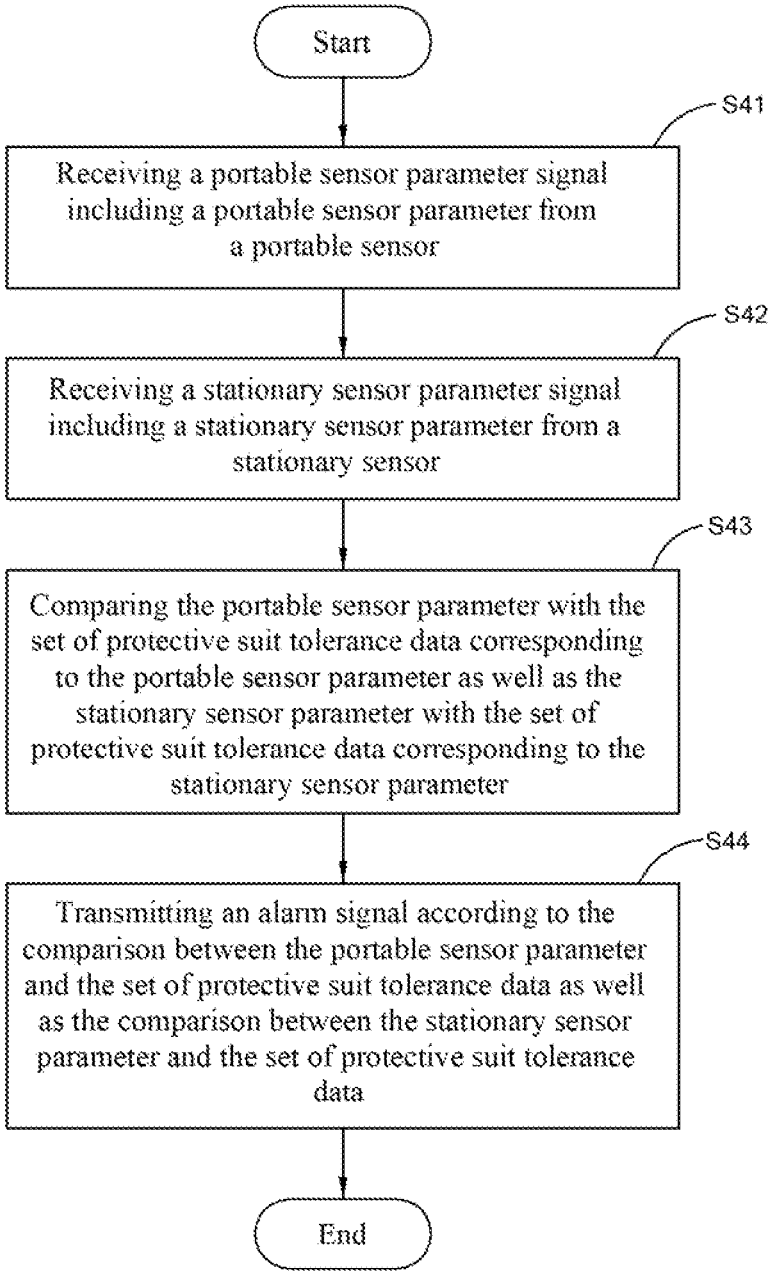
FIG. 6 is a flowchart of a fourth embodiment of an environmental hazard warning method of the present disclosure.

FIG. 6 is a flowchart of a fourth embodiment of an environmental hazard warning method of the present disclosure. As shown in FIG. 6, the environmental hazard warning method of the present disclosure is as follows. Depending on the embodiment, additional steps may be added, others removed, and the ordering of the steps may be changed.

In step S41, a portable sensor parameter signal including a portable sensor parameter is received from a portable sensor.

In step S42, a stationary sensor parameter signal including a stationary sensor parameter is received from a stationary sensor.

In step S43, the portable sensor parameter is compared with the protective suit tolerance data corresponding to the portable sensor parameter, and the stationary sensor parameter is compared with the protective suit tolerance data corresponding to the stationary sensor parameter.

In step S44, an alarm signal is transmitted according to the comparison between the portable sensor parameter and the protective suit tolerance data as well as the comparison between the stationary sensor parameter and the protective suit tolerance data.

The environmental hazard warning system and the environmental hazard warning method provide alarms of the threats in an emergency scene such as high temperature, toxic gas, strong acid, strong base, electricity leakage, or radioactive ray according to the parameter of a protective suit. As a result, the safety of emergency personnel under the protection of the protective suit can be ensured even under extreme environmental conditions.

While the disclosure has been described by way of example and in terms of preferred embodiment, it is to be understood that the disclosure is not limited thereto. To the contrary, it is intended to cover various modifications and similar arrangements as would be apparent to those skilled in the art. Therefore, the range of the appended claims should be accorded the broadest interpretation so as to encompass all such modifications and similar arrangements.

What is claimed is:

1. An environmental hazard warning system, comprising:

a data unit capable of storing protective suit tolerance data;

a comparison unit, wherein the comparison unit receives a portable sensor parameter signal including at least a portable sensor parameter from a portable sensor, and compares the portable sensor parameter in the portable sensor parameter signal with the protective suit tolerance data corresponding to the portable sensor parameter; and an alarm unit transmitting an alarm signal corresponding to the comparison between the portable sensor parameter and the protective suit tolerance data.

2. The environmental hazard warning system of claim 1, wherein the data unit transforms a protective suit parameter received from a short distance wireless device by a short distance wireless identifier to the protective suit tolerance data.

3. The environmental hazard warning system of claim 2, wherein when the protective suit parameter includes an identifier of a protective suit, the data unit transforms the protective suit parameter to the protective suit tolerance data by selecting a pre-inputted protective suit tolerance data corresponding to the protective suit as the protective suit tolerance data.

4. The environmental hazard warning system of claim 2, wherein when the protective suit parameter includes a parameter of a protective suit, the data unit transforms the protective suit parameter to the protective suit tolerance data by storing the parameter as the protective suit tolerance data.

5. The environmental hazard warning system of claim 1, wherein the data unit is further capable of storing body tolerance data input through an input device, the comparison unit compares the portable sensor parameter in the portable sensor parameter signal with the body tolerance data corresponding to the portable sensor parameter, the alarm unit transmits the alarm signal corresponding to the comparison between the portable sensor parameter and the body tolerance data.

6. The environmental hazard warning system of claim 1, wherein the data unit, the comparison unit, and the alarm unit are installed in a portable device.

7. The environmental hazard warning system of claim 6, wherein the portable sensor communicates with the portable device through a short distance wireless network.

8. The environmental hazard warning system of claim 6, wherein the portable device includes an augmented reality glasses, the augmented reality glasses displays an augmented reality image according to the alarm signal.

9. The environmental hazard warning system of claim 1, wherein the comparison unit further receives a stationary sensor parameter signal including a stationary sensor parameter from a stationary sensor, and compares the portable sensor parameter in the portable sensor parameter signal with the protective suit tolerance data corresponding to the portable sensor parameter as well as the stationary sensor parameter in the stationary sensor parameter signal with the protective suit tolerance data corresponding to the stationary sensor parameter, the alarm unit transmits the alarm signal according to the comparison between the portable sensor parameter and the protective suit tolerance data corresponding to the portable sensor parameter as well as the comparison between the stationary sensor parameter and the protective suit tolerance data corresponding to the stationary sensor parameter.

10. The environmental hazard warning system of claim 1, wherein the protective suit tolerance data includes one or more values corresponding to one or more environmental parameters.

11. An environmental hazard warning method, comprising:

receiving a portable sensor parameter signal including at least a portable sensor parameter from a portable sensor;

comparing the portable sensor parameter in the portable sensor parameter signal and protective suit tolerance data corresponding to the portable sensor parameter; and transmitting an alarm signal corresponding to the comparison between the portable sensor parameter and the protective suit tolerance data.

12. The environmental hazard warning method of claim 11, further comprising:

using a short distance wireless identifier to receive at least one protective suit parameter from a short distance wireless device; and transforming the protective suit parameter to the protective suit tolerance data.

13. The environmental hazard warning method of claim 12, wherein the step of transforming the protective suit parameter comprises:

selecting a pre-inputted protective suit tolerance data corresponding to a protective suit as the protective suit tolerance data when the protective suit parameter includes an identifier of the protective suit.

14. The environmental hazard warning method of claim 12, wherein the step of transforming the protective suit parameter comprises:

storing a parameter of a protective suit as the protective suit tolerance data when the protective suit parameter includes the parameter of the protective suit.

15. The environmental hazard warning method of claim 11, further comprising:

comparing the portable sensor parameter in the portable sensor parameter signal and body tolerance data input through an input device corresponding to the portable sensor parameter; and transmitting the alarm signal corresponding to the comparison between the portable sensor parameter and the body tolerance data.

16. The environmental hazard warning method of claim 11, wherein the steps are implemented through a portable device.

17. The environmental hazard warning method of claim 16, wherein the portable sensor communicates with the portable device through a short distance wireless network.

18. The environmental hazard warning method of claim 16, further comprising displaying an augmented reality image through an augmented reality glasses of the portable device according to the alarm signal.

19. The environmental hazard warning method of claim 11, further comprising receiving a stationary sensor parameter signal including a stationary sensor parameter from a stationary sensor and comparing the stationary sensor parameter in the stationary sensor parameter signal with the protective suit tolerance data corresponding to the stationary sensor parameter, wherein the step of transmitting the alarm signal includes transmitting the alarm signal according to the comparison between the portable sensor parameter and the protective suit tolerance data corresponding to the portable sensor parameter as well as the comparison between the stationary sensor parameter and the protective suit tolerance data corresponding to the stationary sensor parameter.

20. The environmental hazard warning method of claim 11, wherein the protective suit tolerance data includes one or more values corresponding to one or more environmental parameters.

* * * * *